US010173301B2

(12) United States Patent
Bilanzich

(10) Patent No.: US 10,173,301 B2
(45) Date of Patent: Jan. 8, 2019

(54) ONE-HANDED, QUICK ACTION, LOCKING VISE

(71) Applicant: Robert Bilanzich, Riverton, UT (US)

(72) Inventor: Robert Bilanzich, Riverton, UT (US)

( * ) Notice: Subject to any disclaimer, the term of this patent is extended or adjusted under 35 U.S.C. 154(b) by 112 days.

(21) Appl. No.: 15/089,279

(22) Filed: Apr. 1, 2016

(65) Prior Publication Data

US 2016/0288296 A1 Oct. 6, 2016

Related U.S. Application Data

(60) Provisional application No. 62/178,091, filed on Apr. 1, 2015.

(51) Int. Cl.
*B25B 1/14* (2006.01)
*B25B 1/24* (2006.01)
*B25B 1/12* (2006.01)

(52) U.S. Cl.
CPC ..... *B25B 1/14* (2013.01); *B25B 1/12* (2013.01); *B25B 1/2489* (2013.01)

(58) Field of Classification Search
CPC .... B25B 1/02; B25B 1/08; B25B 1/24; B25B 1/2421; B25B 1/2489; B25B 5/02; B25B 1/12; B25B 1/14
USPC ..... 269/71, 171.5, 165, 166, 192, 194, 202, 269/203, 227, 171; 81/126, 128; 248/231.41
See application file for complete search history.

(56) References Cited

U.S. PATENT DOCUMENTS 1,421,370 A * 7/1922 Ashworth ..... B25B 5/08 269/140
2,405,288 A * 8/1946 Butt ..... B25B 1/04 269/128
2,568,393 A * 9/1951 Helbig ..... B25B 1/08 188/67
2,592,076 A * 4/1952 Spinnler ..... B25B 1/08 269/166
3,666,260 A * 5/1972 Myers ..... B25B 1/06 269/202
8,573,578 B1 * 11/2013 Warth ..... B25B 1/2468 269/228
8,646,738 B2 * 2/2014 Stoob ..... F16M 7/00 248/188.4
9,815,177 B2 * 11/2017 Ursell ..... B25B 5/166
2004/0217532 A1 * 11/2004 Eberle, III ..... B25B 11/00 269/203

(Continued)

*Primary Examiner* — William V Gilbert
(74) *Attorney, Agent, or Firm* — Morriss O'Bryant Compagni Cannon, PLLC

(57) ABSTRACT

The present disclosure includes a vise having a base with a first a channel and at least one rail extending along the base in a longitudinal direction. The base also includes a gear rack fixed within the channel and extending in the longitudinal direction. The vise also includes a first jaw fixed to and extending substantially perpendicular from the base, a second jaw secured to the base and engaged with the at least one rail, and a gear rack link having a body and at least one gear tooth extending from a bottom surface of the body, with the gear tooth configured to engage with the gear rack. The vise also has a handle connected to the second jaw and the gear rack link such that the positions, relative to the base, of the second jaw and the gear rack link are adjustable by manipulating the handle.

10 Claims, 10 Drawing Sheets

(56) References Cited

U.S. PATENT DOCUMENTS

2011/0309561 A1* 12/2011 Hofmann ..... B23Q 1/037
269/203

* cited by examiner

ONE-HANDED, QUICK ACTION, LOCKING VISE

CROSS-REFERENCE TO RELATED APPLICATIONS

This application claims the benefit of Provisional U.S. Patent Application No. 62/178,091, filed on Apr. 1, 2015, which is hereby incorporated by reference herein in its entirety, including but not limited to those portions that specifically appear hereinafter, the incorporation by reference being made with the following exception: in the event that any portion of the above-referenced application is inconsistent with this application, this application superseded said above-referenced application.

STATEMENT REGARDING FEDERALLY SPONSORED RESEARCH OR DEVELOPMENT

Not Applicable.

BACKGROUND OF THE INVENTION

The invention relates to a machine/drill vise that has sufficient stability and ease of use such that a user can operate the vise one handed even when the vise is not bolted down.

Conventional drill or machining vises typically use cam and screw tightening type mechanical systems that require significant force to achieve a desired jaw force to allow a user to comfortably work on a part being held in place by the vise. Accordingly, because the user has to impart such significant force on the vise, the entire vise can tip or move, even when the user attempts to stabilize the vise with two hands.

The features and advantages of the present disclosure will be set forth in the description that follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1A:
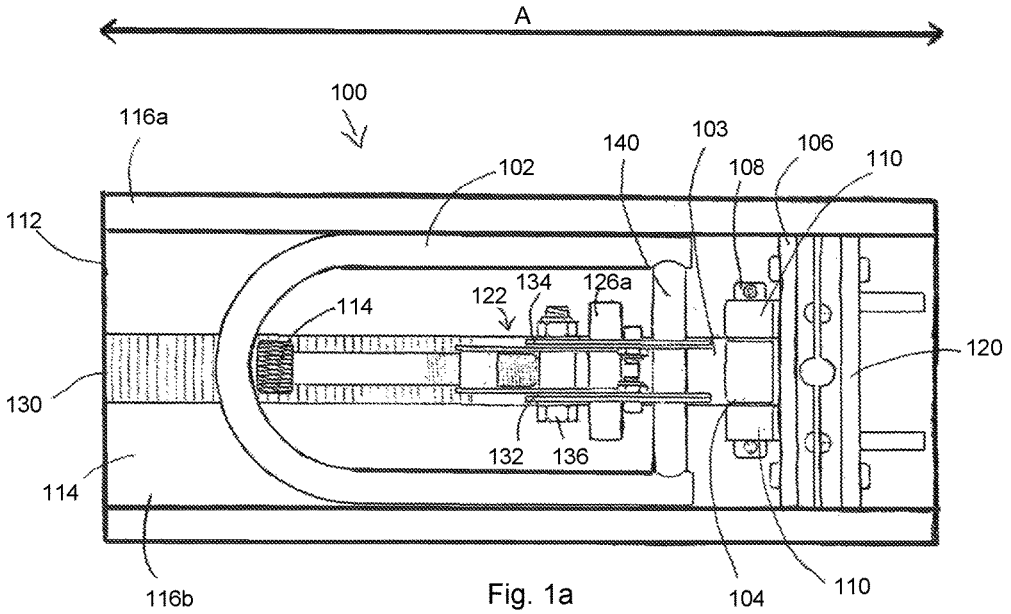
FIG. 1*a* is a top view of a vise embodiment of the present disclosure.

For the purposes of promoting an understanding of the principles in accordance with the disclosure, reference will now be made to the embodiments illustrated in the drawings and specific language will be used to describe them. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

FIGS. 1*a*-1*d*\ illustrate an embodiment of the present disclosure, a vise 100 including a handle 102 that provides a user with a secure grip and facilitates the full operation of the vise 100 with one hand. The handle 102 is also connected to the vise 100 such that a user can move and transport the vise 100 by simply holding the handle 102. The handle 102 includes an extension portion 103 having a receiving through-hole 104. The handle 102 is connected to a movable jaw 106 via a connecting pin 108. The connecting pin 108 is received by through-hole 104 and a pair of through-holes 110 extending from the movable jaw 106. The connecting pin 108 thereby provides a pivot between the handle 102 and the movable jaw 106 which enables a user to manipulate and adjust the movable jaw 106 using only the handle 102.

The vise 100 also includes a base 112. The base 112 includes a central channel 114 that extends the length, or substantially the length, of the base 112 in a longitudinal direction A with respect to the base 112. The base 112 also includes a pair of rails 116*a* and 116*b* that extend both vertically and horizontally about the central channel 114. The rails 116*a* and 116*b* are configured to secure and guide the movable jaw 106, so that the movable jaw 106 can translate in a longitudinal direction A with respect to the base 112, but secure the movable jaw 106 against vertical movement with respect to the base 112. The movable jaw 106 includes a slot 118 that is dimensioned to slidably receive rails 116*a* and 116*b* without the need for lubrication. This configuration enables a user to adjust the movable jaw 106 to compensate for objects of different sizes or dimensions.

A fixed jaw 120 can be secured to the base 112 such that the fixed jaw 120 extends in a substantially vertical direction with respect to the base 112. The fixed jaw 120 if configured to be fixed against all movement with respect to the base 112 and can be secured to the base 112 via welding, bolts, or any other known fastening mechanism. The movable jaw 106 and fixed jaw 120 combine to directly contact and secure, via clamping force, a desired work piece.

The disclosed vise 100 enables a user to tighten and untighten the movable jaw 106, adjust the movable jaw 106 clamping force, including locking the movable jaw in place without imparting any clamping force on a work piece. The vise 100 also includes a free sliding total travel speed adjustment feature in the longitudinal direction A of the base 112. These features can be used and manipulated with one hand, without ever having to let go of the handle 102, which enables a user to use a free hand to hold the work piece, operate a drill press or mill, etc. This singled handed operation can be exceptionally beneficial, for example, when loading longer and heaver work pieces, not centered in the jaws, which would require a user to support the work piece while tightening the vise.

Another key feature of the vise 100 is the speed of tightening and loosening the vise 100. As will be explained in more detail below, the handle 102 can actuate the clamping of the movable jaw 106 by utilizing a small amount of travel of the handle 102. For example, a user can actuate full clamping force of the movable jaw 106 or fully loosen the movable jaw 106 by simply moving the handle 102 about 2 inches. In other embodiments, the vise 100 may be configured to require more or less travel of the handle 102 to switch from a fully clamped position to a fully loosened position. The clamping force can be applied by squeezing together the handle 102 and an adjustment screw 142 (adjustment screw 142 is described in more detail below), which enables a user to clamp a work piece with more stability. The vise 100 can be loosened by pushing the handle 102 away from adjustment screw 142 with a user's thumb leveraging against the adjustment screw 142. Alternatively, the clamping force can be applied by pressing the handle 102 toward the base 112 and to loosen the vise 100 is simply the opposite, pulling the handle 102 away from the base 112. A greater clamping force can also be achieved by changing the ratio of the movable jaw 106 movement from linear to exponential with respect to the handle 102.

Figure 4A:
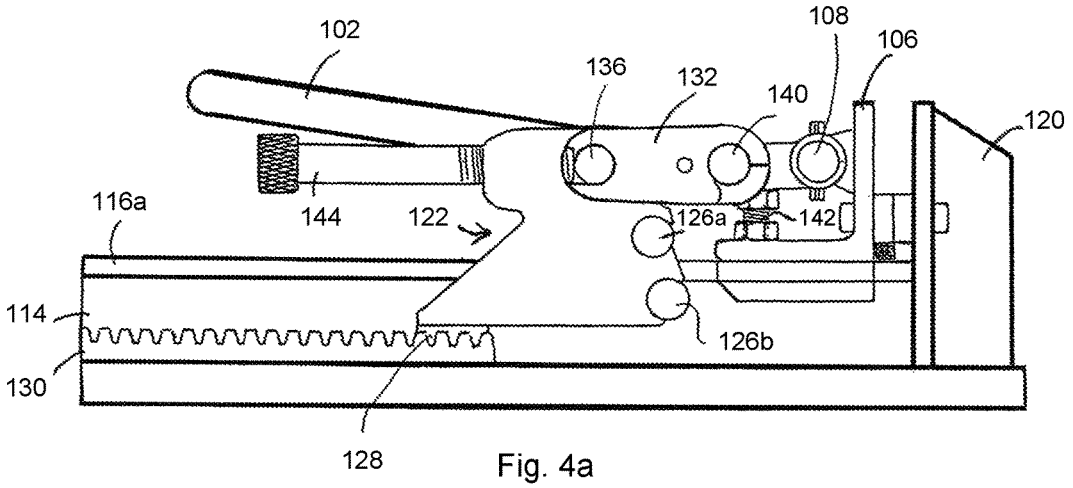
FIG. 4*a* is a side view of the vise embodiment of FIG. 1 in a lock-out position.
Figure 4B:
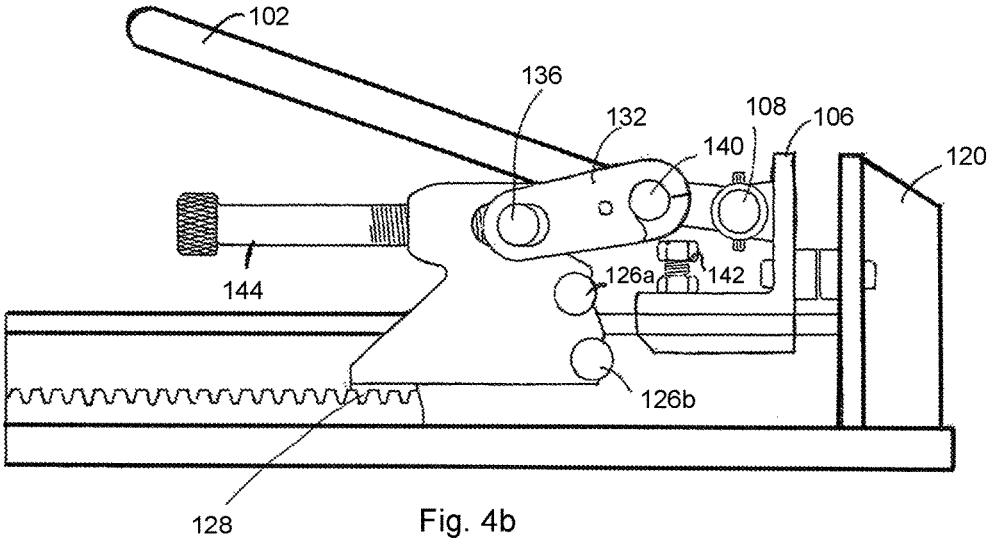
FIG. 4*b* is a side view of the vise embodiment of FIG. 1 in a partially disengaged position.
Figure 4C:
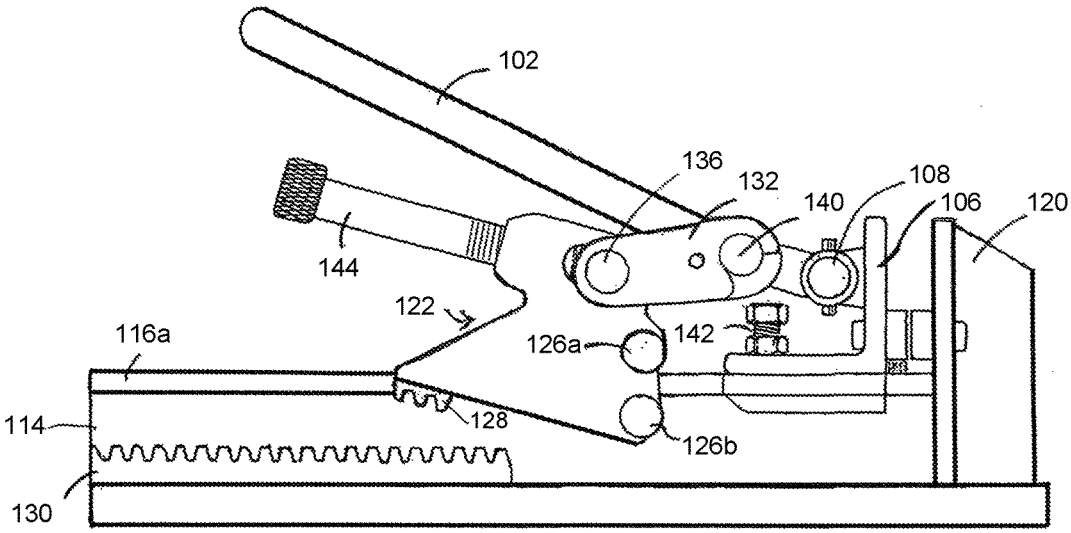
FIG. 4*c* is a side view of the vise embodiment of FIG. 1 in a disengaged position.
Figure 4D:
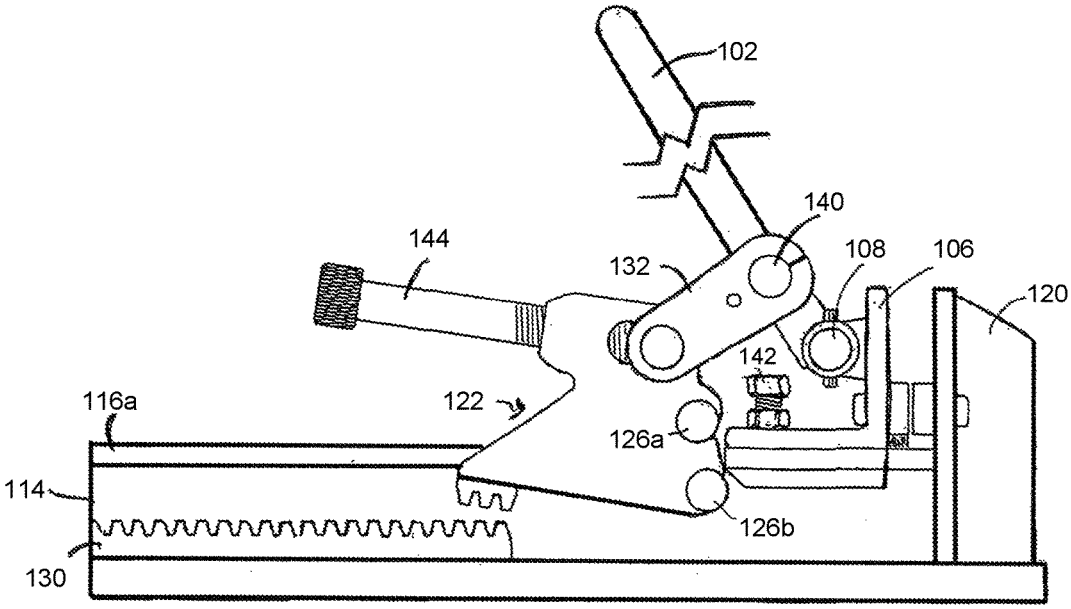
FIG. 4*d* is a side view of the vise embodiment of FIG. 1 in a fully disengaged position.

As shown in FIGS. 1*a*-2*b*, the vise 100 also includes a gear rack link 122. The gear rack link 122 includes a body 124 having a pair of rail guides 126*a* and 126*b*. These rail guides 126*a* and 126*b* are configured and dimensioned to slidably receive the rails 116*a* and 116*b* of the base 112, enabling the gear rack link 122 to translate in a longitudinal direction A with respect to the base 112. The gear rack link 122 also includes a plurality of gear teeth 128 extending from a bottom portion of the body 124. In alternative embodiments, the gear rack link 122 may include any desired number of gear teeth or a single tooth. The gear teeth 128 are dimensioned and configured to engage with a gear rack 130. The gear rack 130 extends linearly along a bottom portion of the channel 114 in the longitudinal direction A with respect to the base 112. When the gear teeth 128 are fully engaged with gear rack 130, the gear rack link 124 is positionally fixed with respect to the base 112, which facilitates the transfer of the clamping force from the handle 102 to the movable jaw 106, as shown in FIGS. 4*a* and 4*b*. The gear teeth 128 can be disengaged from the gear rack 130 by pivoting the gear rack link 122 about the rail guide 126*a*, away from the base 112, as shown in FIGS. 4*c* and 4*d*. Accordingly, a user can adjust the position of the gear rack link 122 with respect to the base 112 by pivoting the gear rack link 122 and sliding the gear rack link 122 along the rails 116*a* and 116*b*, until a desired position is achieved. Then, the gear rack link 122 can be pivoted in the opposite direction, reengaging the gear teeth 128 with the gear rack 130.

The gear rack link 122 is connected to the handle 102 via two pairs of connector links 132 and 134. In an alternative embodiment, a single connector link could be used instead of a pair of links. Each individual connector link 132 and 134 includes two holes 132*a* and 132*b*, or slots (in the disclosed embodiment the connector links 132 and 134 include a slot on one end, instead of simply having two holes, to increase the ease of assembly). The connector links 132 and 134 are pivotally connected to the gear rack link 122 via a connector pin 136. The connector pin 136 is received through a pair of oblong openings 138*a* and 138*b* in the gear rack link body 124, and through corresponding holes 132*a* of and 134*a* in each pair of connector links 132 and 134. The connector links 132 and 134 are also connected to handle 102 via receiving a cross bar 140 of the handle 102, through the holes 132*b* and 134*b*.

Figure 1B:
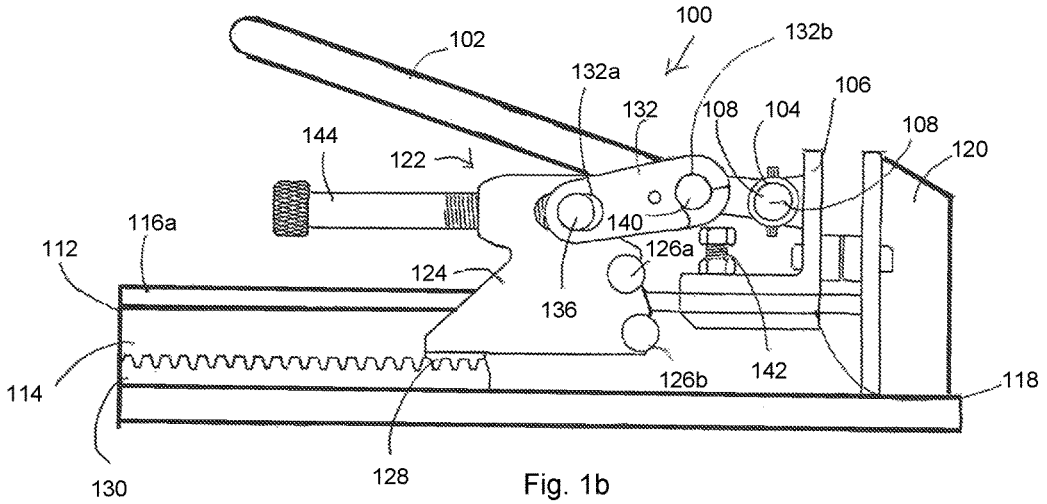
FIG. 1*b* is a side view of the vise embodiment of FIG. 1.
Figure 1C:
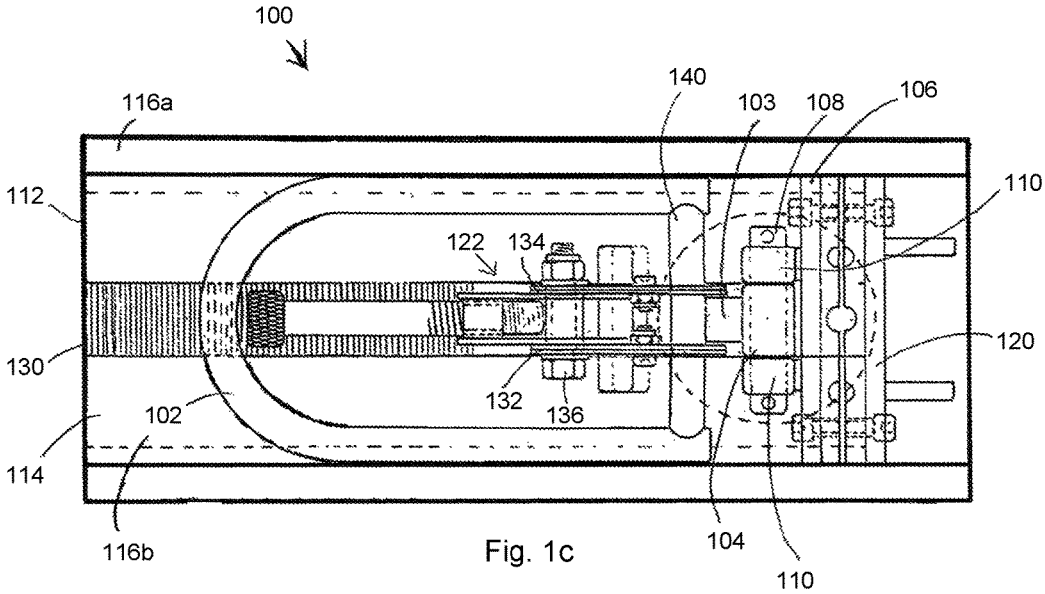
FIG. 1*c* is a top view of the vise embodiment of FIG. 1, with broken lines illustrating structure not in view.
Figure 1D:
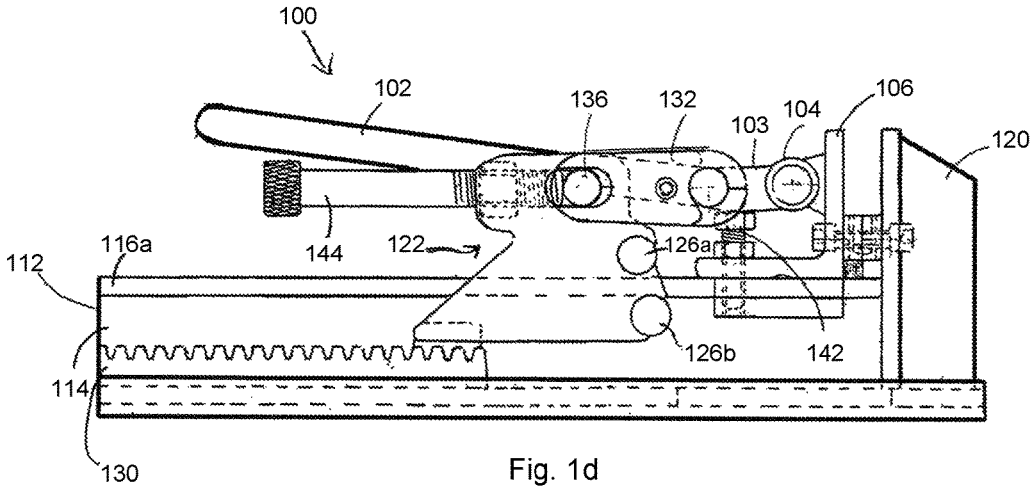
FIG. 1*d* is a side view of the vise embodiment of FIG. 1, with broken lines illustrating structure not in view.
Figures 2A, 2B:
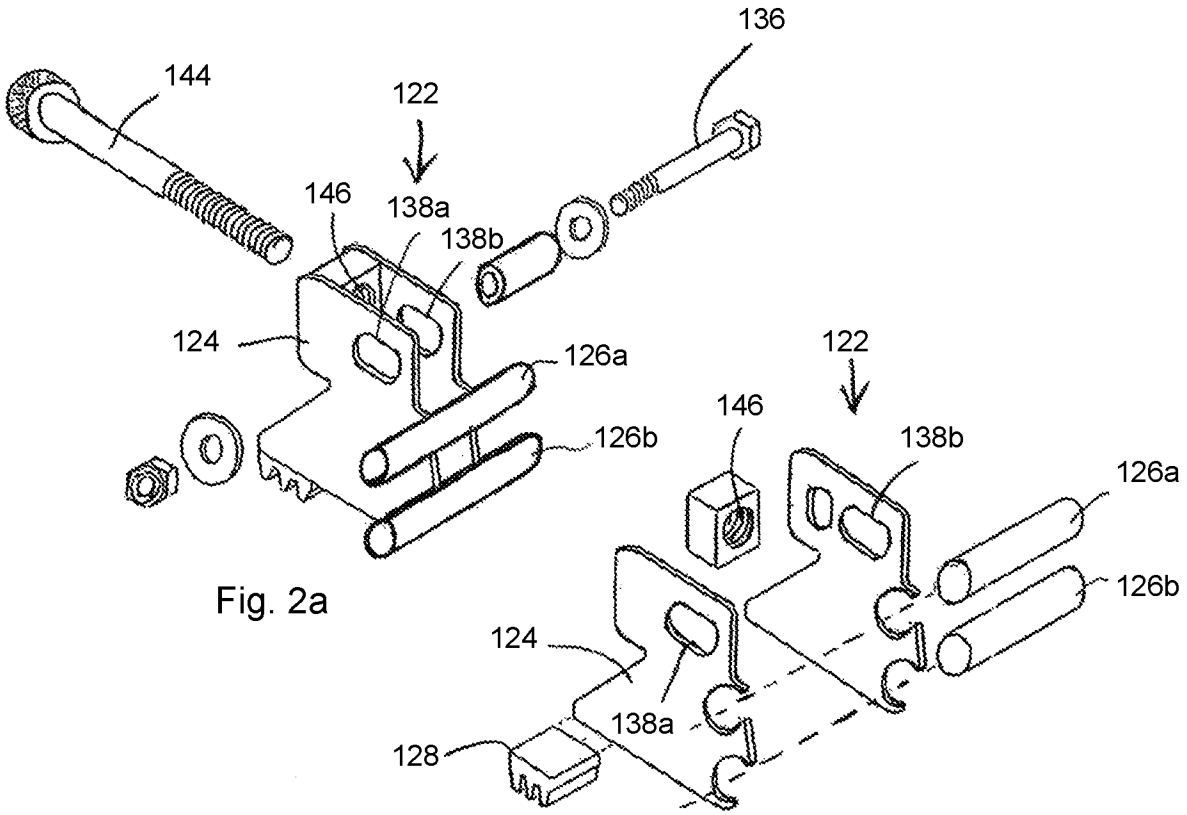
FIG. 2*a* is a partially exploded perspective view of a gear rack link of the vise embodiment of FIG. 1.
FIG. 2*b* is a further exploded perspective view of a gear rack link of the vise embodiment of FIG. 1.
Figure 3:
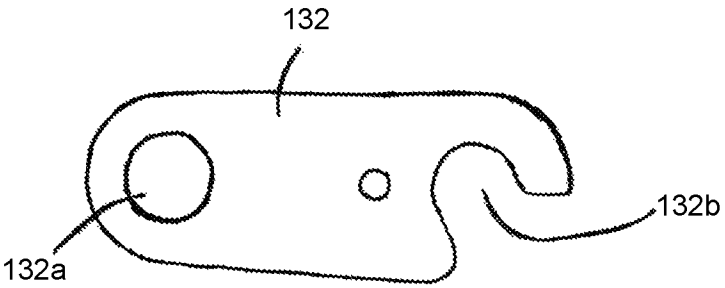
FIG. 3 is a side view of a connector link of the vise embodiment of FIG. 1.

The combination of the pivots created by the connector pin 108, the cross bar 140 and connector pin 136, create an over-center knee lock configuration. In such a configuration, when the handle 102 is in a disengaged position, as shown in FIGS. 1*b* and 4*b* -4*c*, the cross bar 140 is not linearly aligned with connector pins 108 and 136, which equates to an unlocked position giving a limited (or varying) amount of play to the movable jaw 106.

When the handle 102 is fully engaged, pushed down toward the base 112, the cross bar 140 will become linearly aligned with connector pins 108 and 136, forming a "locked-out" or secured position. The oblong openings 138*a* and 138*b* enable the connector pin 136 to translate horizontally with respect to the gear rack link 122, which enables a user to adjust the distance between the gear rack link 122 and the movable jaw 106, when in a loose or unlocked position. Then, as the handle 102 is pushed into the "locked-out" position, connector pin 136 will translate away from the movable jaw 106 until the connector pin 136 abuts an adjustment pin 144 or a terminating end of the oblong openings 138*a* and 138*b*. Once the connector pin 136 can no longer translate away from the movable jaw 106, all of the clamping force generated by the movement of the handle 102 is then transferred to the movable jaw 106, there by clamping the workpiece between the movable jaw 106 and the fixed jaw 120.

The adjustment pin 144 can be threadly engaged with a threaded hole 146 in the gear rack link 122. This threaded engagement enables a user to fine tune, or adjust, the amount of clamping force to be transferred to the work piece, via the movable jaw 106, at the "lock-out" position, by adjusting the amount of travel the connector pin 136 has within the oblong openings 138*a* and 138*b*.

The movable jaw 106 includes a bottom-out post 142 which abuts the extension portion 103 and/or cross bar 140 of the handle 102 when the cross bar 140 becomes linearly aligned with the connector pins 108 and 136. The bottom-out post 142 can prevent the cross bar 140 from over extending beyond the "locked-out" position. In an alternative embodiment, the height of the bottom-out post 142 may be adjustable as desired.

Figure 5:
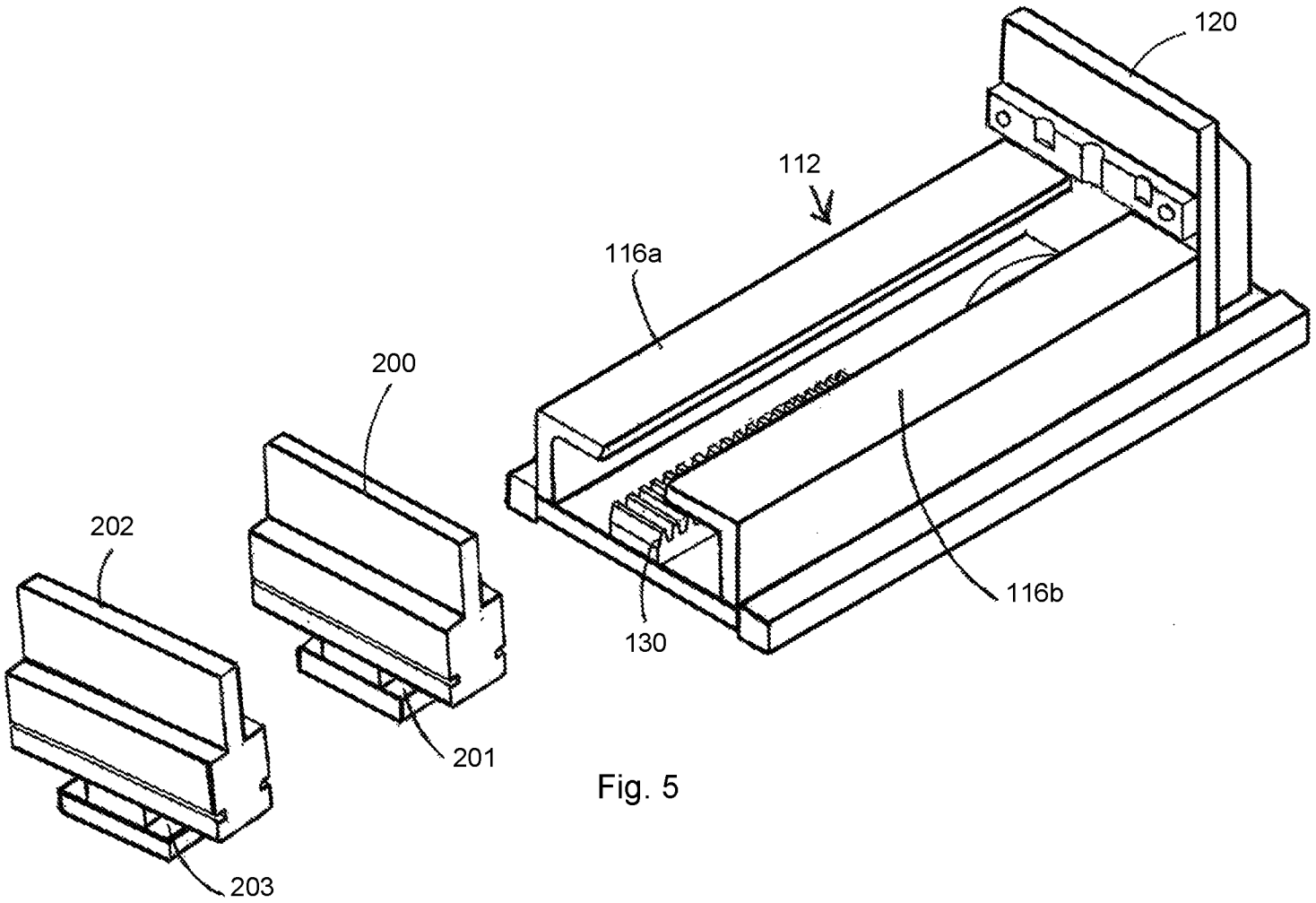
FIG. 5 is a perspective view of another vise embodiment of the present disclosure having slide-in jaws.
Figure 6:
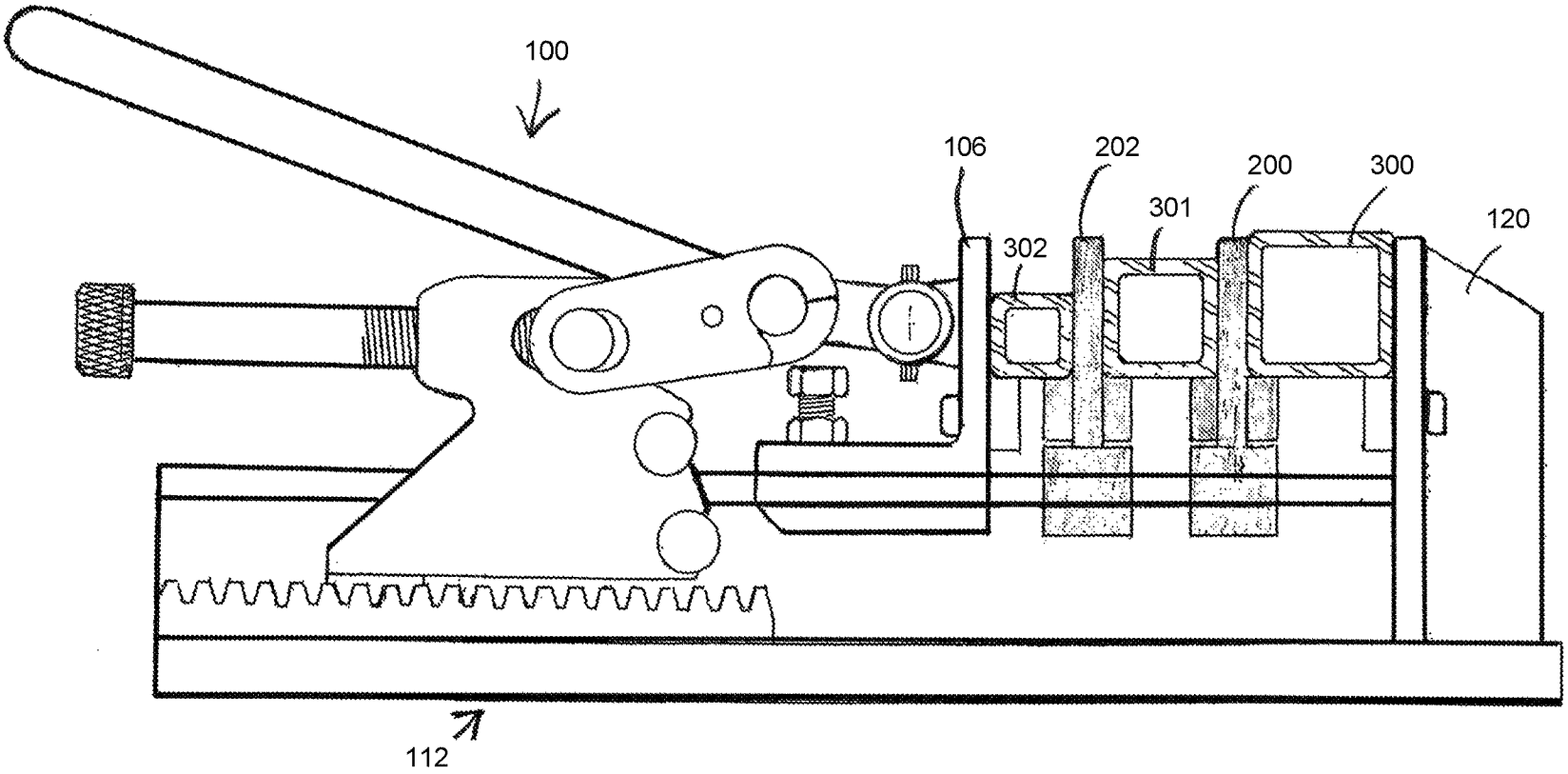
FIG. 6 is a side view of the vise embodiment of FIG. 5.

FIGS. 5 and 6 illustrate an alternative embodiment configured with the base 112 which can receive multiple slide-in jaws 200 and 202 that can slide onto the rails 116*a* and 116*b* via corresponding slots 201 and 203 on the slide-in jaws 200 and 202, in the same manner as the movable jaw 106. After the slide-in jaws 200 and 202 have been positioned on the base 112, the movable jaw 106 and gear rack link 122 can be assembled onto the base 112 in the same manner as shown in FIG. 6. With the incorporation of the slide-in jaws 200 and 202, the vise 100 can accommodate multiple work pieces 300, 301, and 302, of varying size and shape.

Figure 7:
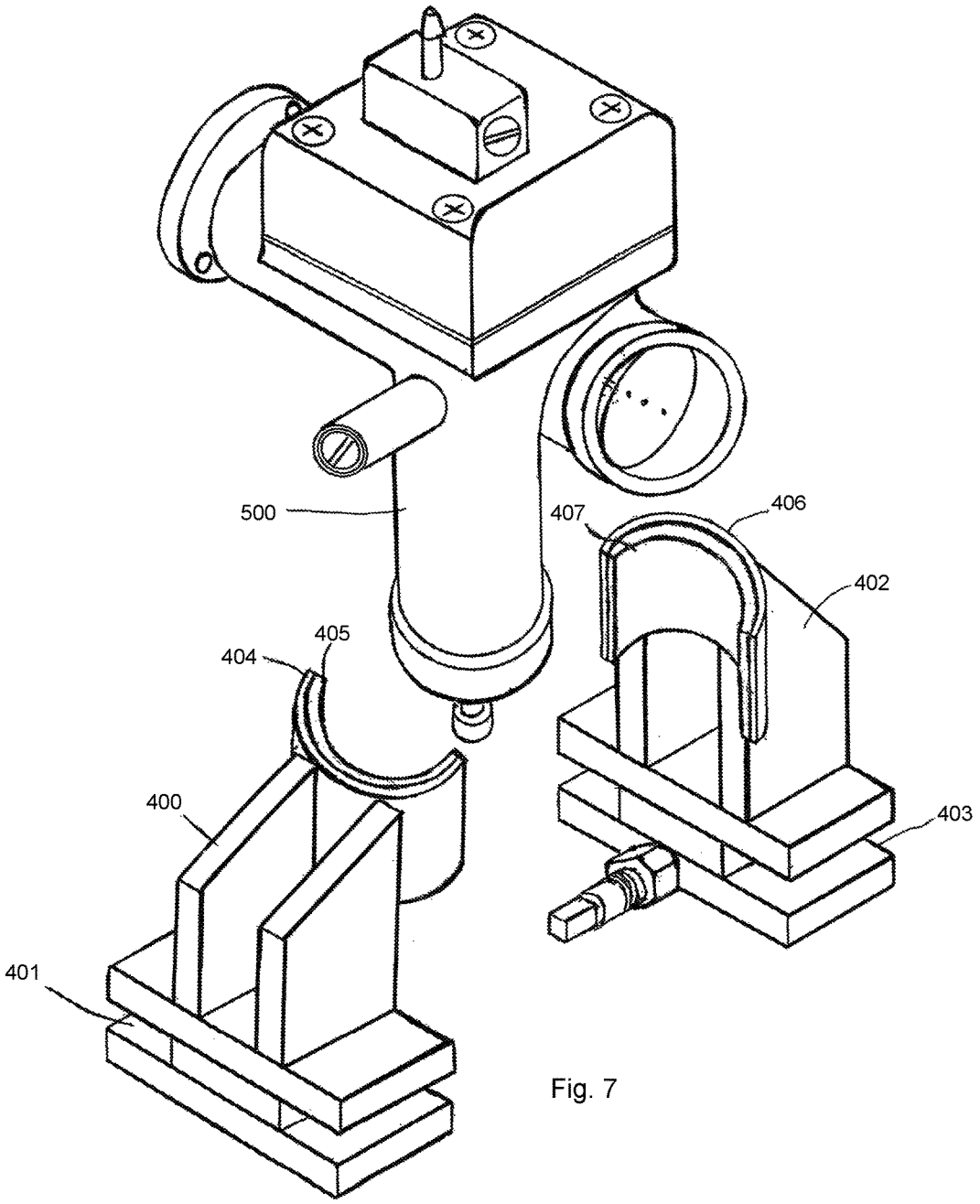
FIG. 7 is a perspective view of another vise embodiment having alternative jaws.

FIG. 7 illustrates another embodiment of the present disclosure. In this embodiment, alternative jaws 400 and 402 can be used in conjunction with vise 100, described above. Jaws 400 and 402 can slide onto the rails 116*a* and 116*b* of base 112 via corresponding slots 401 and 403. Additionally, jaws 400 and 402 can include complementary semicircular faces 404 and 406, which can better contour to cylindrical or rounded work pieces, such as work piece 500, thereby better securing the work piece when clamped in the vise 100. Jaws 400 and 402 can also include padded liners 405 and 407, which can protect the surface or finish of the work piece 500. Similar liners, having different desired shapes, could also be used in conjunction with any of the jaws described above.

Figure 8:
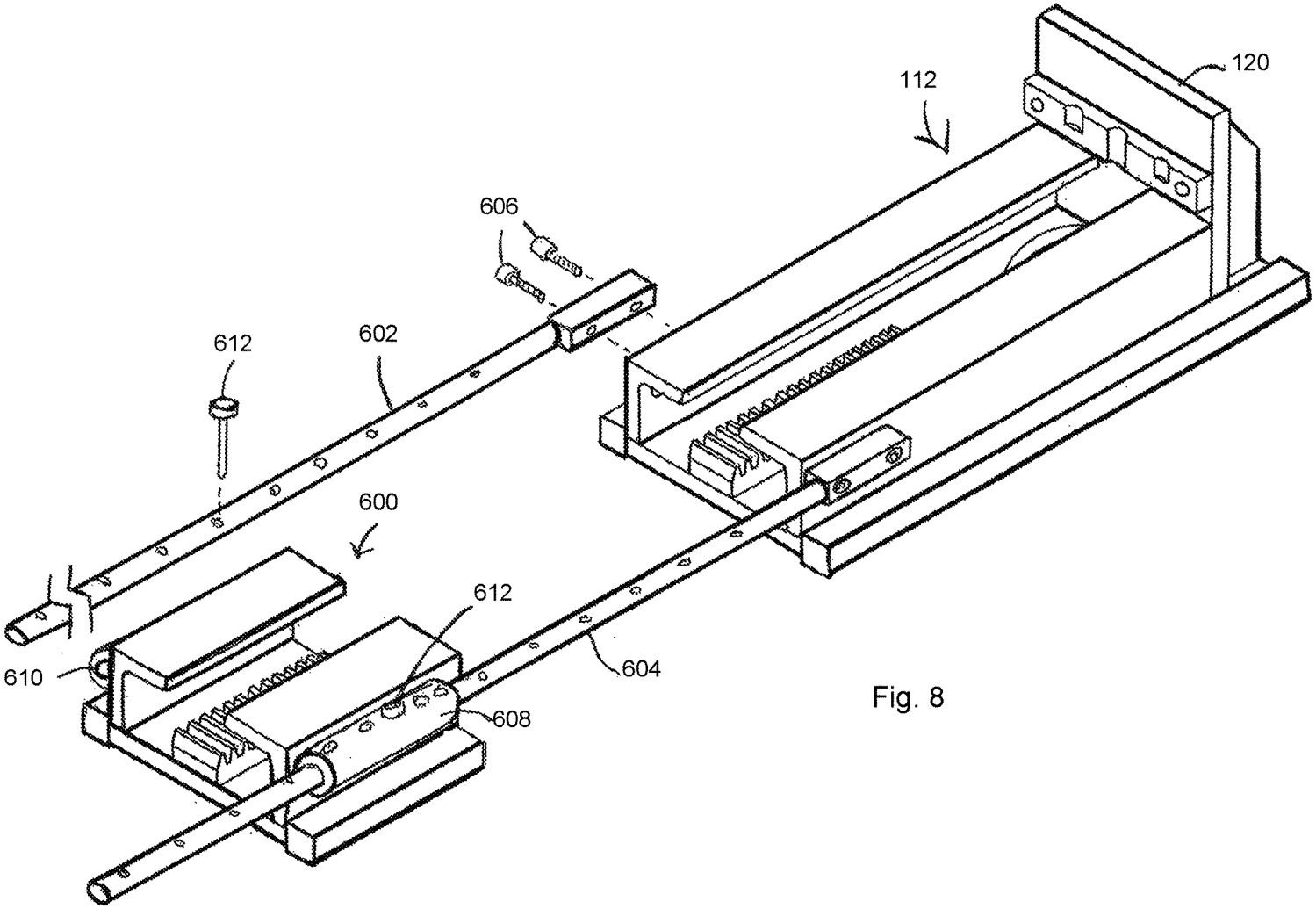
FIG. 8 is a perspective view of another vise embodiment of the present disclosure having a base extension.

FIG. 8 illustrates another embodiment of the present disclosure. In this embodiment, the base 112 can be extended to accommodate larger work pieces. A base extension 600 can include all of the same structural characteristics as base 112 except the base extension 600 does not include a fixed jaw 120. Therefore, the base extension 600 can receive the movable jaw 106 and gear rack link 122 in the same manner as base 112, thereby providing the same functionality as the vise 100 described above, but with a greater space between the movable jaw 106 and the fixed jaw 120.

The base extension 600 can be aligned with and secured to base 112 via extension bars 602 and 604. Extension bars 602 and 604 can be secured to an outer side surface of the base 112 via bolts 606 or any other desired fastening mechanism. Base extension 600 can include sleeves 608 and 610, secured to the outer side surfaces of the base extension 600, which are configured to receive extension bars 602 and 604. Extension bars 602 and 604 can include a plurality of holes along their lengths to facilitate adjustment of the distance between the base extension 600 and the base 112. Once a desired position is achieved, a user can insert a pin 612 into a corresponding hole in both the sleeve 608 and 610 and the extension bar 602 and 604, thereby securing the position of the base extension 600 with respect to the base 112.

The above disclosed vise embodiments provide a number of additional advantages over convention drill or machining vises, such as, the ability to quickly clamp a work piece, the relatively high clamping force when compared to conventional vises requiring a relatively small actuating force. The disclosed vise embodiments also provide a positive locking system, meaning that the corresponding linkage cannot slip or vibrate loose, thus, when loading a work piece in the disclosed vise 100, the disclosed jaws will not slide apart, or come out of adjustment.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A vise comprising:

a base having first a channel and at least one rail extending along the base in a longitudinal direction, wherein the base also includes a gear rack fixed within the channel and extending in the longitudinal direction;

a first jaw fixed to the base;

a second jaw secured to the base and engaged with the at least one rail;

a gear rack link having a body and at least one gear tooth extending from a bottom surface of the body, wherein the gear tooth is configured to engage with the gear rack;

a handle connected to the second jaw and the gear rack link such that the positions, relative to the base, of the second jaw and the gear rack link are adjustable by manipulating the handle, wherein the handle is pivotally engaged with a connector link about a cross bar having a longitudinal axis, and the handle is also pivotally engaged with the second jaw about a first connector pin having a longitudinal axis, wherein the gear rack link is pivotally engaged with the connector link about a second connector pin having a longitudinal axis, wherein the second jaw is locked in a position when the longitudinal axis of the cross bar, the longitudinal axis of the first connector pin and the longitudinal axis of the second connector pin are linearly aligned, in a direction perpendicular to the longitudinal axis of the first connector pin, in an over-center lock configuration.

2. The vise of claim 1, wherein the gear rack link is pivotally engaged with the connector link about the second connector pin, and wherein the second connector pin can translate with respect to the gear rack link.

3. The vise of claim 2, further comprising:

an adjustment pin threadly engaged with the gear rack link, such that the adjustment pin restricts the distance the second connector pin can translate with respect to the gear rack link.

4. The vise of claim 1 wherein the first jaw and the second jaw have opposing surfaces, and wherein the opposing surfaces are semicircular.

5. The vise of claim 1, wherein the gear rack link includes a pair of rail guides that are configured to receive the at least one rail and enable the gear rack link to slide along the at least one rail.

6. A vise comprising:

a base having at least one rail extending linearly along the base, wherein the base also includes a gear rack fixed extending linearly along the base;

a first jaw fixed to the base;

a second jaw secured to the base and engaged with the at least one rail;

a gear rack link having a body and at least one gear tooth extending from a bottom surface of the body, wherein the gear tooth is configured to engage with the gear rack;

a handle connected to the second jaw and the gear rack link such that the positions, relative to the base, of the second jaw are adjustable by manipulating the handle, wherein the handle is connected to the gear rack link via at least one connector link, wherein the handle is pivotally engaged with a connector link about a cross bar having a longitudinal axis, and the handle is also pivotally engaged with the second jaw about a first connector pin having a longitudinal axis, wherein the gear rack link is pivotally engaged with the connector link about a second connector pin having a longitudinal axis, wherein the second jaw is locked in a position when the longitudinal axis of the cross bar, the longitudinal axis of the first connector pin and the longitudinal axis of the second connector pin are linearly aligned, in a direction perpendicular to the longitudinal axis of the cross bar, in an over-center lock configuration.

7. The vise of claim 6, further comprising:

an adjustment pin threadly engaged with the gear rack link, such that the adjustment pin restricts the distance the second connector pin can translate with respect to the gear rack link.

8. The vise of claim 6, wherein the first jaw and the second jaw have opposing surfaces, and wherein the opposing surfaces are semicircular.

9. The vise of claim 6, wherein the gear rack link includes a pair of rail guides that are configured to receive the at least one rail and enable the gear rack link to slide along the at least one rail.

10. The vise of claim 6, wherein the at least one rail includes a pair of parallel rails forming a channel.

* * * * *